United States Patent [19]

Tomioka

[11] 4,184,404

[45] Jan. 22, 1980

[54] NECK FOR A STRINGED INSTRUMENT

[76] Inventor: Michiaki Tomioka, 3135, Zenkojimachi, Kofu-shi, Yamanashi-ken, Japan

[21] Appl. No.: 817,426

[22] Filed: Jul. 20, 1977

[30] Foreign Application Priority Data

Dec. 29, 1976 [JP]· Japan ..... 51/178251[U]

[51] Int. Cl.[2] ..... G10D 3/00

[52] U.S. Cl. ..... 84/293

[58] Field of Search ..... 84/293, 267; 144/281 R, 144/309 XA

[56] References Cited

U.S. PATENT DOCUMENTS

| | | | |
|---|---|---|---|
| 1,960,380 | 5/1934 | Jordan | 144/309 XA |
| 3,805,663 | 4/1974 | Okugawa | 84/293 |

*Primary Examiner*—John Gonzales
*Assistant Examiner*—S. D. Schreyer
*Attorney, Agent, or Firm*—Robert E. Burns; Emmanuel J. Lobato; Bruce L. Adams

[57] ABSTRACT

A neck for a stringed instrument formed of a plywood comprising a lamination of a plurality of sheets of bamboo. A length of bamboo greater than the length of the neck to be produced and having a proper diameter is radially stiffed into equal sectors each having an arcuate section. Both the external and internal surfaces of the sectors are sliced tangentially and the opposite lateral edges of the sectors cut in a direction perpendicular to the tangential direction, thus providing a plurality of sheets of the required length which are rectangular in cross section. Using any known wood lamination technique, the sheets are laminated into a plywood. In a practical embodiment, the plywood is in the form of a straight square timber, the opposite ends of which are cut off, leaving the intermediate portion for use as a neck body. The end portions are used as a peg head and a mounting limb, which are adhesively bonded with the corresponding positions of the neck body portion in given orientations before cutting the plywood into the neck form. Preferably, the major surface of the laminar sheets is aligned in parallel relationship with the surface of the neck body on which a finger board is mounted, or in a direction perpendicular to the last mentioned surface.

4 Claims, 5 Drawing Figures

FIG. 1
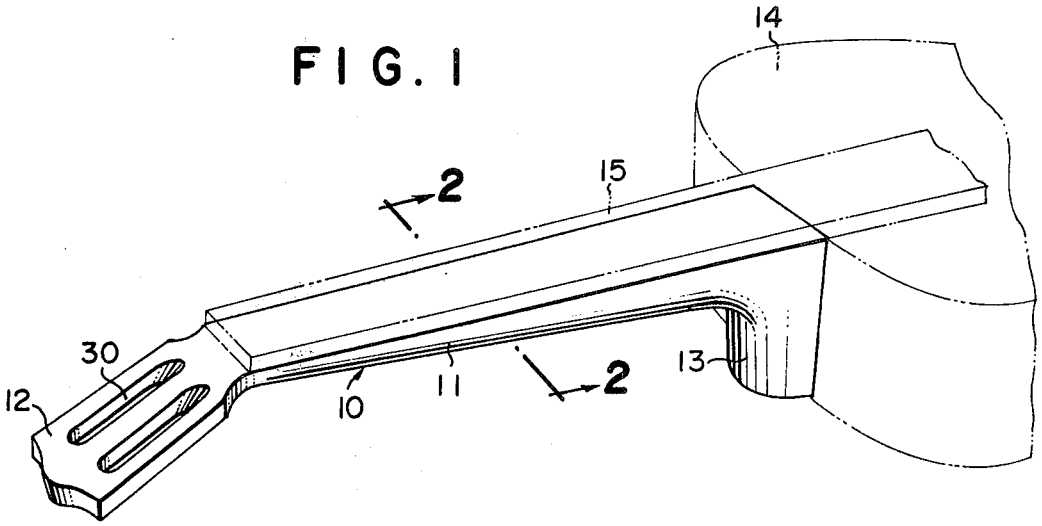
FIG. 2
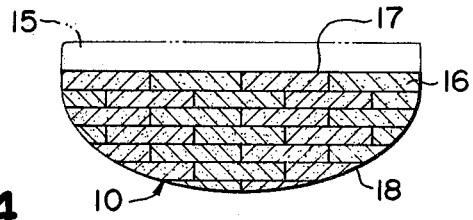
FIG. 4
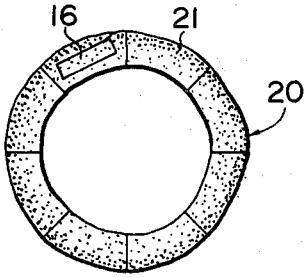
FIG. 3
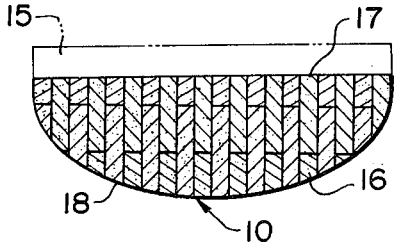
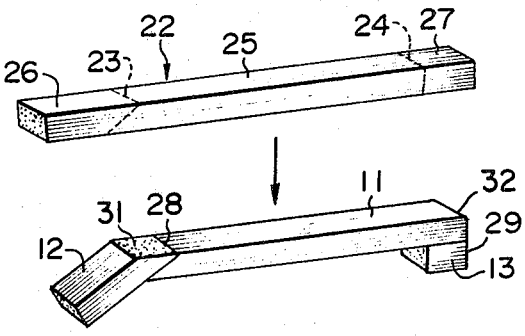
FIG. 5

NECK FOR A STRINGED INSTRUMENT

FIELD AND BACKGROUND OF THE INVENTION

The invention relates to a stringed instrument, and more particularly, to a neck attached to a sound box for supporting strings of a guitar.

A usual stringed instrument has a neck body on which a finger board supporting frets is mounted and which has its one end integrally connected with a peg head and its other end formed with an integral limb for connection with the sound box. The requirement on the neck is its high strength which is sufficient to withstand a high tension in the strings and to prevent the strains from occurring over a prolonged period of use. On the other hand, it is desired that the acoustic attenuation be minimized in view of the delicate influence upon the tone quality. A conventional neck comprises a solid member formed of a maple-tree. However, a high degree of skill and experience is required in the selection of the grain or its orientation when cutting the wood into a square timber or slab and cutting the latter into the form of the neck. The final quality of the resulting products is greatly influenced by such skill if they are formed from the single wood. Another difficulty with the conventional neck material is the tremendous length of the seasoning period required from the lumbering of the wood until a product is finished. When producing an ordinary class product, the seasoning period by natural drying will be nearly three years at the wood level, two years at the timber or slab level and about one year after a rough machining. This implies the necessity of paying an attentive consideration to the procurement of the wood nd the control over the production steps. Though the natural drying may be replaced by a forced drying, it is highly desirable to have the natural seasoning period at the wood and the timber levels in order to minimize the strains which might be caused by the aging effect. A further disadvantage which occurs with the use of the solid neck material is the low proportion of the volume of the product as compared with the required timber volume, meaning a low yield.

Additional disadvantage of the conventional neck is the use of an iron or stainless steel reinforcing rod which is disposed longitudinally thereof along the centerline in order to prevent strains. This increases the overall weight of the instrument.

SUMMARY OF THE INVENTION

It is an object of the invention to provide a neck for a stringed instrument which can be manufactured in a facilitated manner.

It is another object of the invention to provide a neck for a stringed instrument which can be manufactured inexpensively with a high yield.

It is a further object of the invention to provide a neck for a stringed instrument which provides a high strengh without the use of a reinforcing rod.

It is still another object of the invention to provide a process of manufacturing a neck for a stringed instrument which enables products of uniform quality to be manufactured inexpensively without requiring a special skill.

In accordance with the invention, there can be provided a neck for a stringed instrument formed of a plywood comprising a lamination of a plurality of sheets of bamboo. A length of bamboo greater than the length of the neck to be produced and having a proper diameter is radially stiffed into equal sectors each having an arcuate section. Both the external and internal surfaces of the sectors are sliced tangentially and the opposite lateral edges of the sectors cut in a direction perpendicular to the tangential direction, thus providing a plurality of sheets of the required length which are rectangular in cross section. Using any known wood lamination technique, the sheets are laminated into a plywood. In a practical embodiment, the plywood is in the form of a straight square timber, the opposite ends of which are cut off, leaving the intermediate portion for use as a neck body. The end portions are used as a peg head and a mounting limb, which are adhesively bonded with the corresponding positions of the neck body portion in given orientations before cutting the plywood into the neck form. Preferably, the major surface of the laminar sheets is aligned in parallel relationship with the surface of the neck body on which a finger board is mounted, or in a direction perpendicular to the last mentioned surface.

In another embodiment of the invention, the peg head portion and the neck body may be formed by one piece plywood. Before laminating the sheets, the peg head portion of the sheets may be folded to form a given angle with the neck body portion. Alternatively, the peg head portion may be folded after the lamination into the plywood. These techniques can be advantageously employed where the major surface of the sheets is parallel to the plane of the finger board.

A preferred bamboo material used in the invention is a species of bamboo commonly referred to as "MOH-SOH" (phonetically) in Japan and which is "phyllostachys mitis" by nomenclature. This species of of bamboo may have a diameter up to 10 centimeters or more and a thickness even exceeding 1 centimeter. The material has a thin and dense fibre structure, and a high level of toughness or resistance to crack while exhibiting a specific gravity less than that of the conventional wood material for the neck. What is more important, a stabilized strength and a strain-free condition can be attained with this species of bamboo with a seasoning period which is substantially reduced than that of the wood material, and this characteristic has been demonstrated in its applications as rulers and slide rules. The drying period from the felling of bamboo until the sheets are prepared to the lamination extends from several months to one year on the average where natural drying process is employed. However, a forced drying process may be employed which takes place at 100° C. for 20 to 24 hours. A suitable sectional size of the sheets may be 5 mm by 15 mm, for example.

Thus, the invention provides a neck which is reduced in weight and still rigid enough to prevent strains over a prolonged period of use. Also, theinvention provides a neck having a minimized acoustic attenuation, substantially improving the acoustic effect.

BRIEF DESCRIPTION OF THE DRAWINGS

FIG. 1 is a perspective view of the neck according to the invention, also showing part of the sound box and the finger board;

FIG. 2 is a cross section taken along the line 2—2 shown in FIG. 1;

FIG. 3 is a cross section of a modification of the neck;

FIG. 4 is a schematic section of bamboo, illustrating the slitting thereof; and

FIG. 5 is a schematic illustration of the process of manufacturing the neck according to the invention.

DESCRIPTION OF PREFERRED EMBODIMENTS

Referring to FIG. 1, the neck for a stringed instrument according to the invention is generally shown by reference numeral 10. The neck 10 comprises a straight elongate neck body 11, a head 12 extending from one end of the neck body 11 and forming a given angle thereto, and a limb 13 integrally extending from the other end of the neck body 11. The limb 13 serves as the mount to attach the neck 10 to a sound box 14. The neck body 11 includes an arcuate bottom surface 18 and a flat upper surface 17 (see FIGS. 2 and 3) to which is adhesively bonded a finger board 15 extending over the surface of the sound box 14. The head 12 is formed with a pair of slots 30 for receiving pegs of known form, not shown.

In accordance with the invention, the neck 10 is formed of a bamboo plywood. Referring to FIGS. 2 and 3, the plywood comprises a multi-layer lamination of bamboo sheets 16 adhesively secured together, the sheets 16 in one layer being disposed in complementary manner with respect to those in the adjacent layers. In the example shown in FIG. 2, the sheets 16 are oriented so that their major surface lies parallel to the upper surface 17 of the neck body 11 to which the finger board 15 is applied, while in the example of FIG. 3, they are oriented in a perpendicular direction thereto. While the neck having the sheet orientation shown in FIG. 3 has a greater resistance to bending stresses applied as a result of the tension in the strings as compared with the sheet orientation of FIG. 2, it is possible to achieve a satisfactory strength for practical purposes with the arrangement of FIG. 2.

FIG. 4 illustrates the slitting of bamboo 20 into sectors 21. In the example, the bamboo 20 is shown as having a cylindrical section and radially slitted into eight equal sectors each having an arcuate cross section. Both the external and internal surfaces of the sectors 21 are tangentially sliced to form opposite flat surfaces, and the opposite lateral edges cut in a direction perpendicular to the flat surfaces, thus forming the sheets 16. A preferred species of bamboo is "phyllostachys mitis" by nomenclature, which is called "MOHSOH" (phonetically) in Japan. This species grows extensively, principally in the southern part of Japan, and exhibits varying properties depending on the habitat. By experience, it is found that this species of bamboo which grows in the northern district of Shizuoka prefecture and the southern district of Yamanashi prefecture of Japan is most suitable for the purpose of the invention. The bamboo may have a diameter and a thickness well in excess of 10 and 1 centimeter, respectively, and thus bamboo of any desired size may be chosen and splitted into a number of sectors which depends on the size. It is desirable that the final sheets have a sectional size on the order of 5 mm by 15 mm, for example. It is preferable that the bamboo be naturally dried for a period from six months to one year before slitting it into the sectors. However, the bamboo may be slitted and sliced into sheets before the completion of the full drying process, and the sheets subjected to a forced drying, which may be effected at a temperature of 100° C. for 20 to 24 hours in the same manner as the usual wood drying techniques.

FIG. 5 illustrates the formation of a neck from a plywood 22 in the form of a straight square timber. The plywood 22 can be manufactured as a lamination of a number of sheets 16, using the conventional wood lamination technique. Specifically, an adhesive is applied to the individual sheets, which are then secured together under uniform pressure. A known synthetic resin adhesive may be used. The opposite end portions 26, 27 are cut off the plywood along dotted lines 23, 24, leaving the central portion 25 which is to form the neck body 11. It will be noted that the dotted lines 23 extend angularly in accordance with the predetermined angle to be formed between the peg head 12 and the neck body 11 which the dotted lines 24 extend in a direction perpendicular to the length of the neck body portion 25. The end portion 26 is adhesively bonded with the severed surface 28 of the portion 25 by inverting the portion 26 so that its severed surface 31 is coplanar with the upper surface of the neck body portion 25. Though not shown, the severed surface 31 of the portion 26 may be bonded with the lower surface of the portion 25 so that the severed surface 28 lies in coplanar relationship with the upper surface of the peg head portion 26. The other end portion 27 is adhesively bonded with the lower surface of the portion 25 so that the severed surface 29 of the end portion 27 is flush with the severed surface 32 of the portion 25. In this manner, the approximate configuration of the neck 10 is achieved, and a finish machining to the final neck form is then conducted.

The described process of manufacturing the neck is equally applicable to either sheet orientation shown in FIG. 2 or FIG. 3. However, since the angle between the peg head 12 and the neck body 11 is generally a relatively small value, the portion 26 need not be cut off the plywood 22 but the peg head may be folded from the plane of the neck body portion 25 where the sheet orientation of FIG. 2 is employed. Alternatively, with the sheet orientation of FIG. 2, prefolded sheets may be used to provide the peg head 12 integral with the neck body 11 and having the given angle with respect to the latter. In this case, it is only necessary to join the limb 13 with the neck body 11.

What is claimed is:

1. A neck for a musical instrument, dimensioned for being attached to a sound box of a musical instrument, for carrying a finger board thereon and for supporting strings of a musical instrument; said neck comprising: an elongated neck body, a head extending from one end of said neck body, and a limb extending from the other end of said neck body for attaching said neck to a sound box of a musical instrument; said neck body, head and limb each comprising a multi-layer lamination of adhesively bonded flat rectangular cross section bamboo sheets having major surfaces defined by slicing bamboo stalks in the tangential direction thereof; said neck body having an end face defining a given angle with the length dimension of said neck body; and said head mounted on said neck body parallel to said end face so that said head extends from said neck body at said given angle relative to the length dimension of said neck body.

2. A neck according to claim 1 in which each layer of the plywood comprises a plurality of closely juxtaposed sheets, the sheets in each layer being disposed in a complementary manner with those in its adjacent layers.

3. A neck according to claim 1 in which the bamboo is of a species "phyllostachys mitis" by nomenclature.

4. A neck according to claim 1 in which the sheets are rectangular in cross section and measures 5 mm by 15 mm.

* * * * *